US007497707B2

(12) United States Patent
Wu et al.

(10) Patent No.: US 7,497,707 B2
(45) Date of Patent: Mar. 3, 2009

(54) FOLDABLE ELECTRICAL CONNECTOR AND POWER SUPPLY APPARATUS HAVING SAME

(75) Inventors: Wen-Ching Wu, Taoyuan Hsien (TW); Ya-Hui Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/751,767

(22) Filed: May 22, 2007

(65) Prior Publication Data

US 2008/0076279 A1 Mar. 27, 2008

(30) Foreign Application Priority Data

Sep. 26, 2006 (TW) ..... 95135630 A

(51) Int. Cl.
*H01R 29/00* (2006.01)

(52) U.S. Cl. ..... 439/172

(58) Field of Classification Search ..... 439/131, 439/172, 11, 37, 13, 501, 158
See application file for complete search history.

(56) References Cited

U.S. PATENT DOCUMENTS

D408,786 S * 4/1999 Goto ..... D13/138.1
6,991,469 B1 * 1/2006 Wang ..... 439/31
7,001,196 B1 * 2/2006 Huang ..... 439/320
7,134,887 B1 * 11/2006 Keely ..... 439/131
2004/0053536 A1 * 3/2004 Chen et al. ..... 439/638

FOREIGN PATENT DOCUMENTS

WO WO 98/09363 * 3/1998

* cited by examiner

*Primary Examiner*—Neil Abrams
*Assistant Examiner*—Phuong Nguyen

(57) ABSTRACT

A power supply apparatus includes a main body, a first power connecting part and a foldable electrical connector. The main body includes a power converting circuit therein and has a first socket at a first side thereof. The first power connecting part has an end connected to the main body. The foldable electrical connector includes a housing and at least a conductive pin. The housing includes a connecting member and a receiving portion. The connecting member is electrically connected to the first socket of the main body. The conductive pin is disposed in the receiving portion and multi-angularly rotatable with respect to the housing so as to be selectively stored in the receiving portion or protruded from the housing.

20 Claims, 12 Drawing Sheets

FOLDABLE ELECTRICAL CONNECTOR AND POWER SUPPLY APPARATUS HAVING SAME

FIELD OF THE INVENTION

The present invention relates to an electrical connector, and more particularly to a foldable electrical connector. The present invention also relates to a power supply apparatus having such a foldable electrical connector.

BACKGROUND OF THE INVENTION

Recently, the general trends in designing portable electronic devices are toward small size, light weightiness and easy portability. The portable electronic devices such as mobile phones, personal digital assistants (PDAs), digital still cameras, digital video cameras, notebook computers and the like have built-in batteries. If no external power supply apparatus is provided to power the portable electronic device, the built-in battery is usually used as the main power source. If the power supplied from the battery is insufficient, the user may simply plug an electrical connector of a power supply apparatus (e.g. an AC-to-DC power adapter or a charger) into an AC wall outlet commonly found in most homes or offices so as to receive an AC power. The AC power is then converted into a DC power to be used for the portable electronic device and/or charge the built-in battery.

Referring to FIG. 1, a schematic view of a conventional power supply apparatus is illustrated. The power supply apparatus 1 includes a main body 11, a first power connecting part 12 and a second power connecting part 13. A first side 110 of the main body 11 includes an input socket 111. The input socket 111 includes a plurality of conductive pins 112 having first terminals electrically connected to a circuit board (not shown) within the main body 11 and second terminals accommodating within a receiving portion 113 thereof. The AC voltage transmitted from the external power source is converted by the circuitry of the circuit board inside the main body 11 into a regulated DC output voltage.

The first power connecting part 12 includes an output plug 120 and a power cable 121. The power cable 121 has an end connected to the circuit board (not shown) within the main body 11 and the other end connected to the output plug 120. The output plug 120 may be plugged into a power receiving socket of a portable electronic device such as a notebook computer, so that the regulated DC output voltage is transmitted to the portable electronic device. The second power connecting part 13 includes a first input plug 130, a power cable 131 and a second input plug 132. The first input plug 130 is plugged into the input socket 111 of the main body 11. The first plug 130 has conductive pins electrically connected to the conductive pins 112 of the input socket 111. The second input plug 132 may be plugged into an AC wall outlet commonly found in most homes or offices so as to receive an AC power.

When the power supply apparatus 1 is used with a portable electronic device such as a notebook computer, the output plug 120 of the first power connecting part 12 is plugged into the power receiving socket of the portable electronic device, and the first input plug 130 is plugged into the input socket 111 of the main body 11 and the second input plug 132 is plugged into an AC wall outlet. The AC voltage is transmitted from the external power source to the power supply apparatus 1 through the second input plug 132, the power cable 131 and the first input plug 130 of the second power connecting part 13, and then converted by the circuitry of the circuit board inside the main body 11 into a regulated DC output voltage. The regulated DC output voltage is then supplied to the portable electronic device through the power cable 121 and the output plug 120 of the first power connecting part 12, thereby powering the portable electronic device and/or charging a battery built-in the portable electronic device.

Although the power supply apparatus can provide direct power and recharging capabilities, there are still some drawbacks. For example, a strap is usually used to secure a bundled power cable for storage. The bundled power cable, which is suspended over the main body, results in an inferior appearance and occupies a lot of space. In addition, the AC voltages from the external power sources are varied in different countries. That is, a set of the second power connecting part 13 may fail to be used everywhere. If another set of the second power connecting part 13 is carried, the volume and the overall weight of the baggage are increased. Moreover, due to the restriction of the space utilization, the power supply apparatus 1 may sometimes need to be hung on the wall. If the second power connecting part 13 is detached from the main body 11 in response to an external force applied on the power cable 131, abrupt power interruption will occur and the power supply apparatus 1 may have a breakdown.

For solving the above problems, another power supply apparatus was developed. Referring to FIG. 2, a schematic view of another conventional power supply apparatus is illustrated. The power supply apparatus 2 includes a main body 21, a first power connecting part 22 and a second power connecting part 23. A first side 210 of the main body 21 includes an input socket 211. The input socket 211 includes a plurality of conductive pins 212 having first ends electrically connected to a circuit board (not shown) within the main body 21 and second terminals accommodating within a receiving portion thereof. The first power connecting part 22 includes an output plug 220 and a power cable 221. The power cable 221 has an end connected to the circuit board (not shown) within the main body 21 and the other end connected to the output plug 220. The output plug 220 may be plugged into a power receiving socket of a portable electronic device such as a notebook computer, so that the regulated DC output voltage is transmitted to the portable electronic device. Especially, the second power connecting part 23 is substantially an electrical connector which is also referred as a duck head connector. The second power connecting part 23 includes a housing 230, conductive pins 231 and a protrusion portion 232. The conductive pins 231 have first terminals accommodated within the protrusion portion 232 and second terminals protruded from a surface the housing 230. After the protrusion portion 232 is inserted into the input socket 211 of the main body 21, the conductive pins within the protrusion portion 232 are electrically connected to the conductive pins 212 within the input socket 211.

The second power connecting part 23 has no power cable, so that the problem of storing the power cable is solved. However, since the conductive pins 231 are protruded from the housing 230 and non-foldable, the conductive pins 231 may fail to be plugged into an AC wall outlet to receive an AC voltage if the utilization space is very narrow. Therefore, the power supply apparatus 2 is not suitable in many circumstances.

In views of the above-described disadvantages resulted from the conventional method, the applicant keeps on carving unflaggingly to develop a foldable electrical connector according to the present invention through wholehearted experience and research.

SUMMARY OF THE INVENTION

It is an object of the present invention to provide a foldable electrical connector capable of permitting multi-angle and all-oriented rotation of the conductive pin, so that the conductive pin may be stored or protruded out as required.

Another object of the present invention is to provide a power supply apparatus having such a foldable electrical connector.

In accordance with a first aspect of the present invention, there is provided a power supply apparatus. The power supply apparatus comprises a main body, a first power connecting part and a foldable electrical connector. The main body includes a power converting circuit therein and has a first socket at a first side thereof. The first power connecting part has an end connected to the main body. The foldable electrical connector includes a housing and at least a conductive pin. The housing includes a connecting member and a receiving portion. The connecting member is electrically connected to the first socket of the main body. The conductive pin is disposed in the receiving portion and multi-angularly rotatable with respect to the housing so as to be selectively stored in the receiving portion or protruded from the housing.

In accordance with a second aspect of the present invention, there is provided a foldable electrical connector of a power supply apparatus. The power supply apparatus comprises a main body including a power converting circuit therein and having a first socket at a first side thereof. The foldable electrical connector comprises a housing and at least a conductive pin. The housing includes a connecting member and a receiving portion, wherein the connecting member is electrically connected to the first socket of the main body. The conductive pin is disposed in the receiving portion and multi-angularly rotatable with respect to the housing so as to be selectively stored in the receiving portion or protruded from the housing.

In accordance with a third aspect of the present invention, there is provided a power supply apparatus. The power supply apparatus comprises a main body, a first power connecting part, a second power connecting part and a foldable electrical connector. The main body includes a power converting circuit therein and having a first socket at a first side thereof. The first power connecting part has an end connected to the main body. The second power connecting part includes a first input plug, a power cable and a second input plug, wherein the first input plug is selectively connected to the first socket of the main body. The foldable electrical connector includes a housing and at least a conductive pin. The housing includes a connecting member and a receiving portion. The conductive pin is disposed in the receiving portion and multi-angularly rotatable with respect to the housing, and the connecting members are selectively connected to the first socket of the main body. Especially, a first input voltage is received by the second input plug when the first input plug of the second power connecting part is connected to the first socket of the main body, and a second input voltage is received by the conductive pin when the connecting member of the foldable electrical connector is connected to the first socket of the main body.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
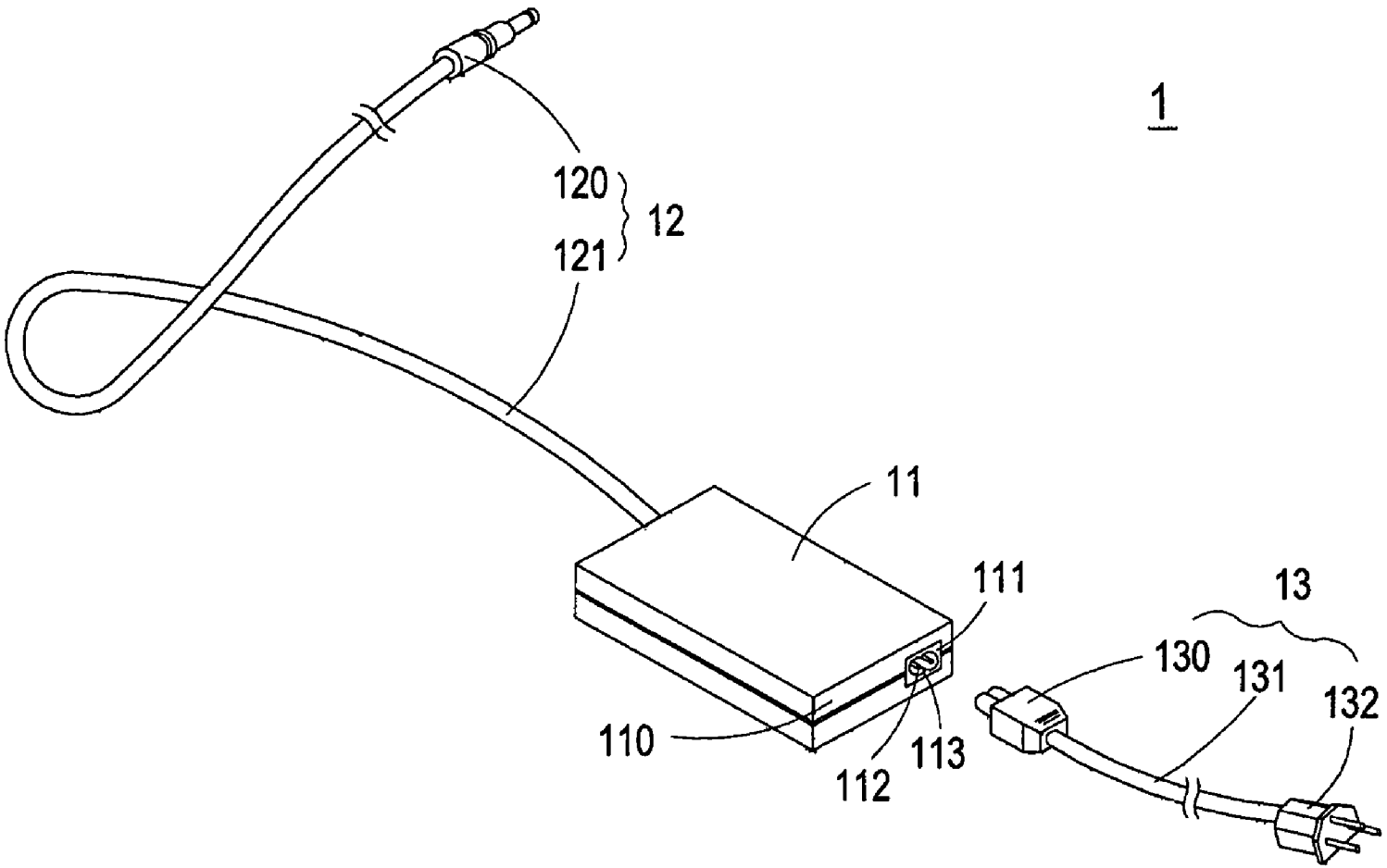
Fig. 1 Prior Art
FIG. 1 is a schematic view of a conventional power supply apparatus.
Figure 2:
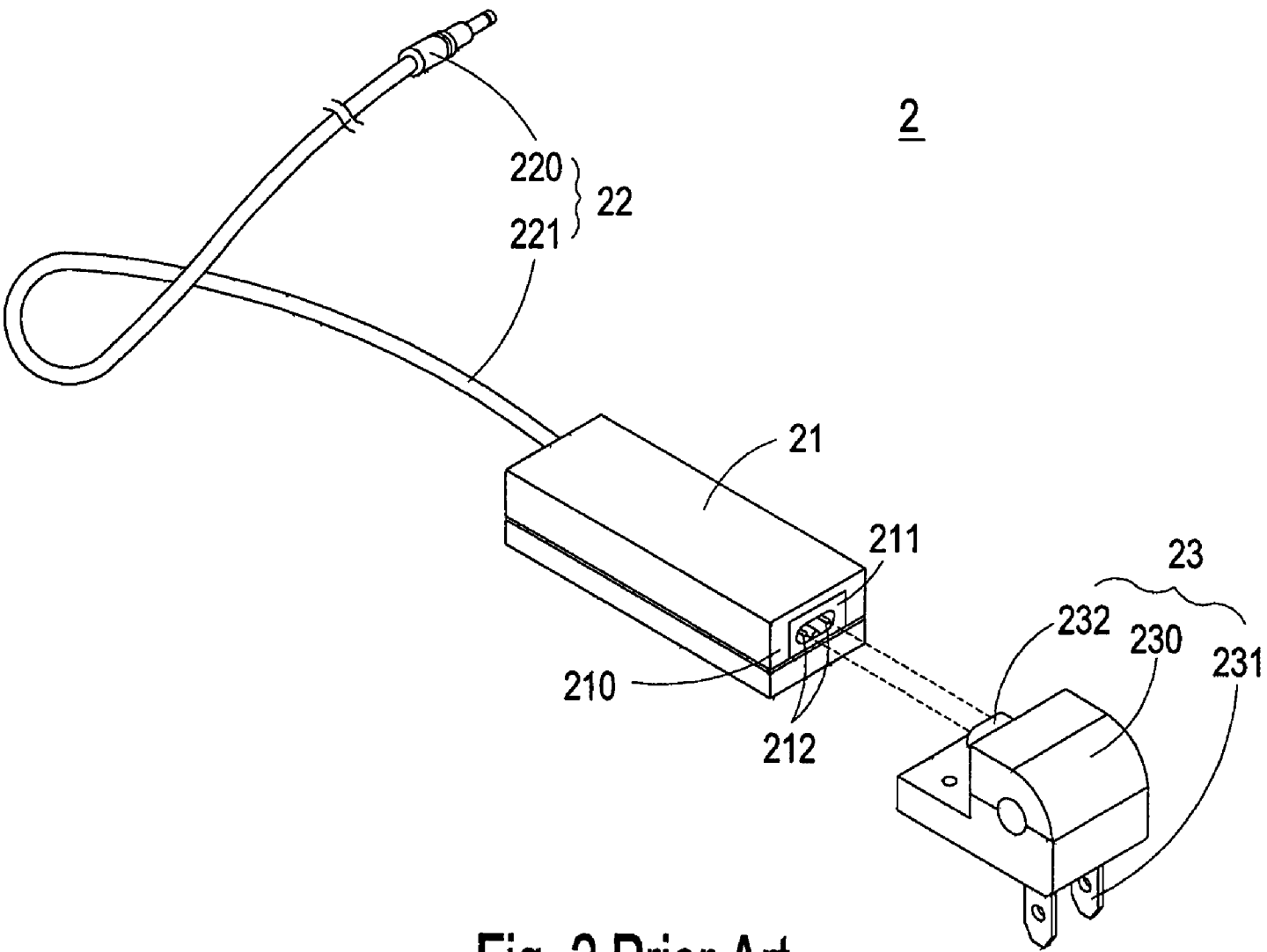
Fig. 2 Prior Art
FIG. 2 is a schematic view of another conventional power supply apparatus.
Figure 3:
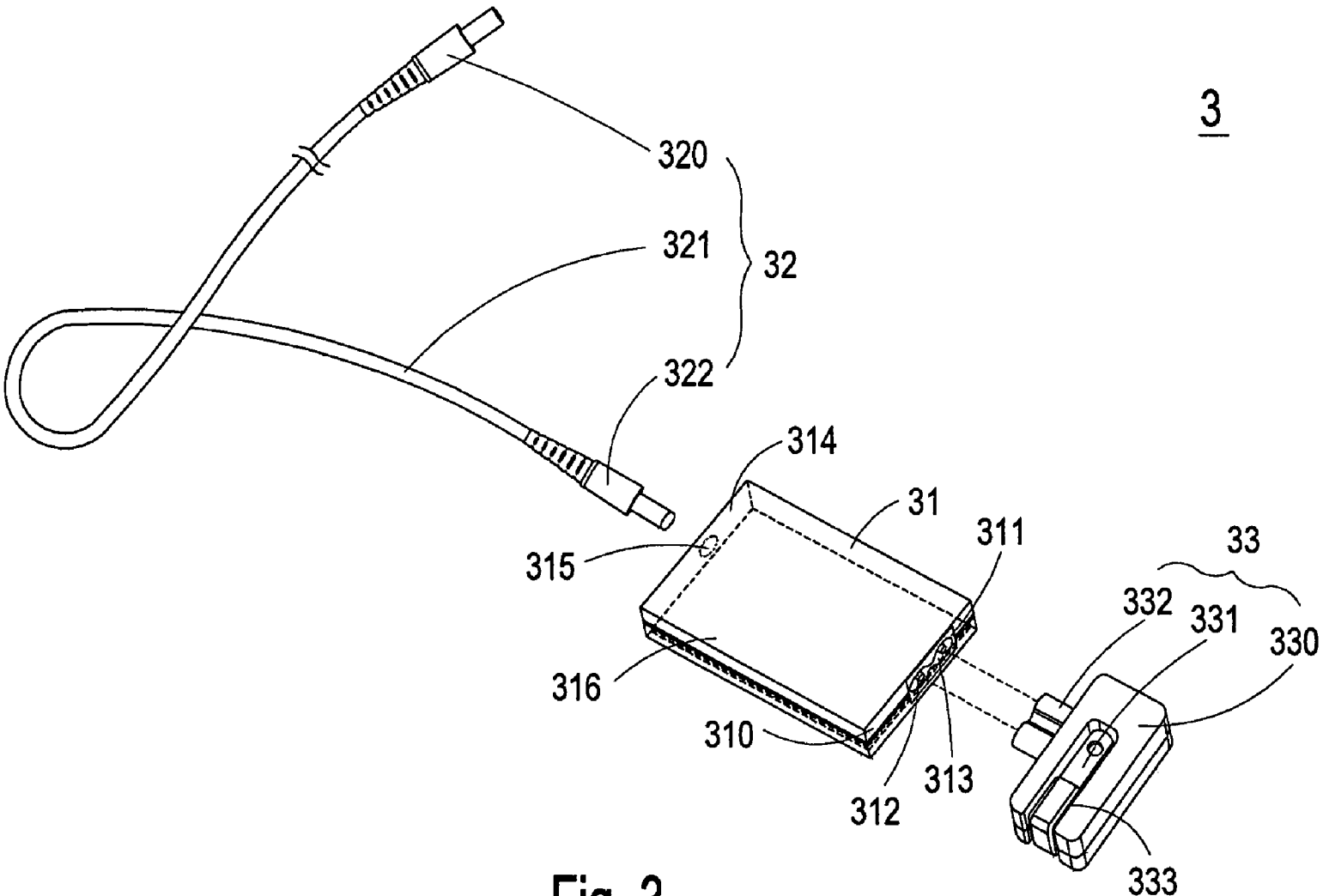
FIG. 3 is a schematic view of a power supply apparatus according to a preferred embodiment of the present invention.
Figure 4B:
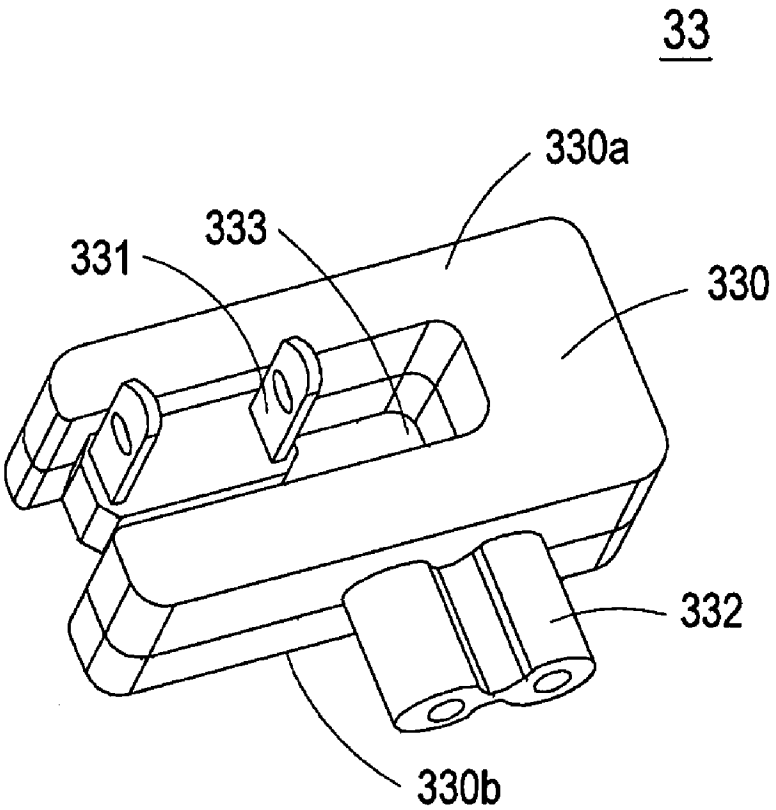
FIGS. 4(*a*), 4(*b*), 4(*c*) and 4(*d*) schematically illustrate several usage situations of the foldable electrical connector.
Figure 4A:
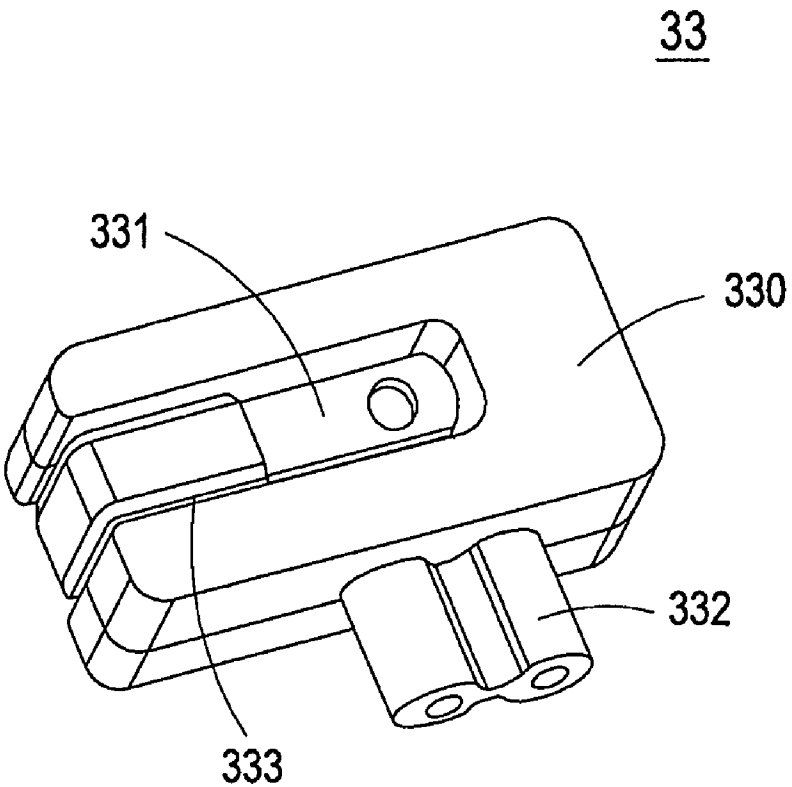
Figure 4D:
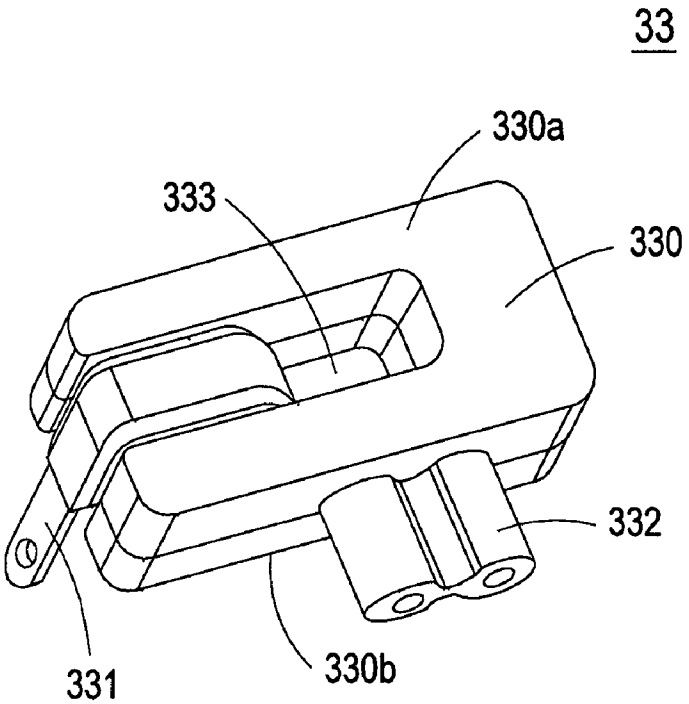
Figure 4C:
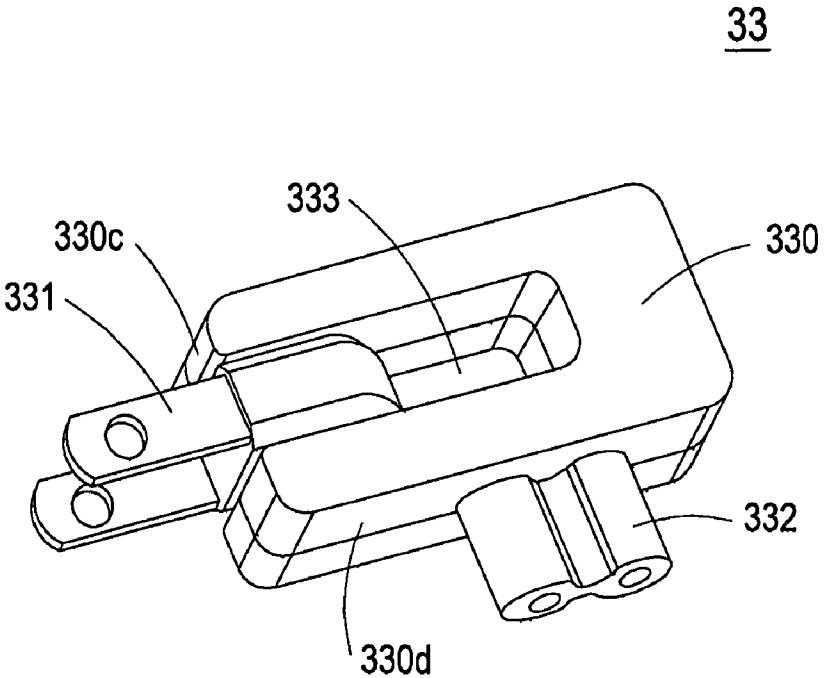

Referring to FIG. 3, a schematic view of a power supply apparatus according to a preferred embodiment of the present invention is illustrated. The power supply apparatus 3 includes a main body 31, a first power connecting part 32 and a foldable electrical connector 33. The main body 31 of the power supply apparatus 3 includes a circuit board 316 having a power converting circuit (not shown) therein. A first side 310 of the main body 31 includes an input socket 311. The input socket 311 includes a plurality of conductive pins 312 having first terminals electrically connected to the circuit board 316 within the main body 31 and second terminals accommodated within a receiving portion 313 thereof. A second side 314 of the main body 31 includes an output socket 315. The output socket 315 is also electrically connected to the circuit board 316. The AC voltage transmitted from the external power source is converted by the circuitry of the circuit board inside the main body 31 into a regulated DC output voltage.

The first power connecting part 32 includes a first output plug 320, a power cable 321 and a second output plug 322. The second output plug 322 may be plugged into the output socket 315 of the main body 31. The first output plug 320 will be plugged into a power receiving socket of a portable electronic device such as a notebook computer, so that the regulated DC output voltage is transmitted to the portable electronic device.

Please refer to FIG. 3 again. The foldable electrical connector 33 includes a housing 330 and at least one conductive pin 331. The housing 330 includes a connecting member 332 and a receiving portion 333. The connecting member 332 is detachably inserted into the input socket 311 of the main body 31. The conductive pin 331 can be received in the receiving portion 333 and rotated with respect to the housing 330. In a case that the foldable electrical connector 33 is not used, the connecting member 332 may be detached from the input socket 311 of the main body 31 and a multi-angle rotation of the conductive pin 331 is rendered to have the conductive pin 331 stored within the receiving portion 333. Whereas, during operation of the power supply apparatus 3, the conductive pin 331 is rotated to be exposed out of the receiving portion 333 so as to be plugged into an AC wall outlet to receive an AC voltage.

Please refer to FIGS. 4(*a*), 4(*b*), 4(*c*) and 4(*d*), which illustrate several usage situations of the foldable electrical connector 33. As shown in FIG. 4(*a*), when the conductive pin 331 is rotated to be received in the receiving portion 333 of the housing 330, the conductive pin 331 fails to be plugged into the AC wall outlet and the foldable electrical connector 33 is not used. As shown in FIG. 4(*b*), the conductive pin 331 is rotated to be exposed out of the receiving portion 333 and protruded from a first surface 330*a* of the housing 330. As shown in FIG. 4(*d*), the conductive pin 331 is rotated to be exposed out of the receiving portion 333 and protruded from a second surface 330*b* of the housing 330. In this embodiment, the second surface 330*b* is opposite to the first surface 330*a*. As shown in FIG. 4(*c*), the conductive pin 331 is rotated to be exposed out of the receiving portion 333 and protruded from a first sidewall 330*c* of the housing 330. In FIGS. 4(*b*), 4(*c*) and 4(*d*), the conductive pin 331 may be plugged into an AC wall outlet to receive an AC voltage. As a consequence, multi-angle and all-oriented rotation of the conductive pin 331 is possible. Please refer to FIG. 4(*c*) again. The receiving portion 333 of the foldable electrical connector 33 is concavely extended from the first sidewall 330*c* of the housing 330. The connecting member 332 is protruded from a second sidewall 330*d* of the housing 330. In this embodiment, the second sidewall 330*d* is next to the first sidewall 330*c*.

Figure 5B:
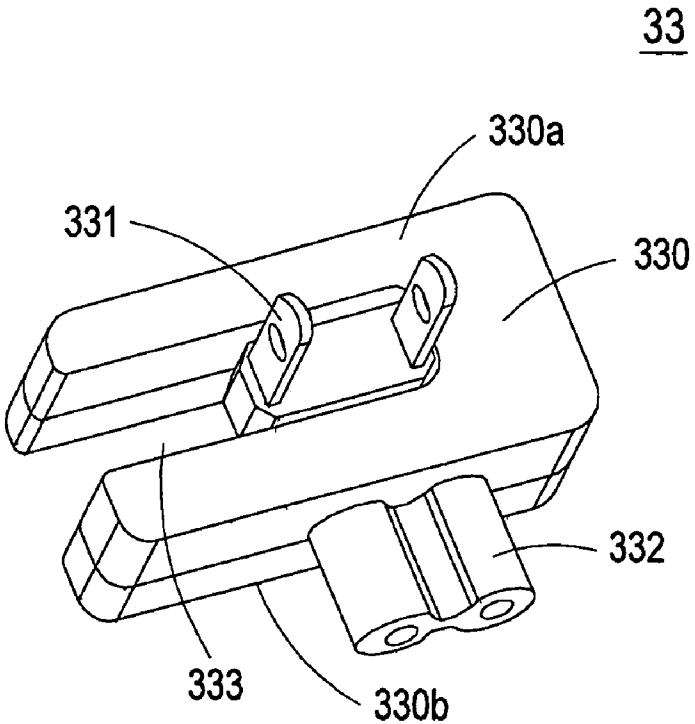
FIGS. 5(*a*), 5(*b*) and 5(*c*) schematically illustrate several usage situations of the foldable electrical connector.
Figure 5A:
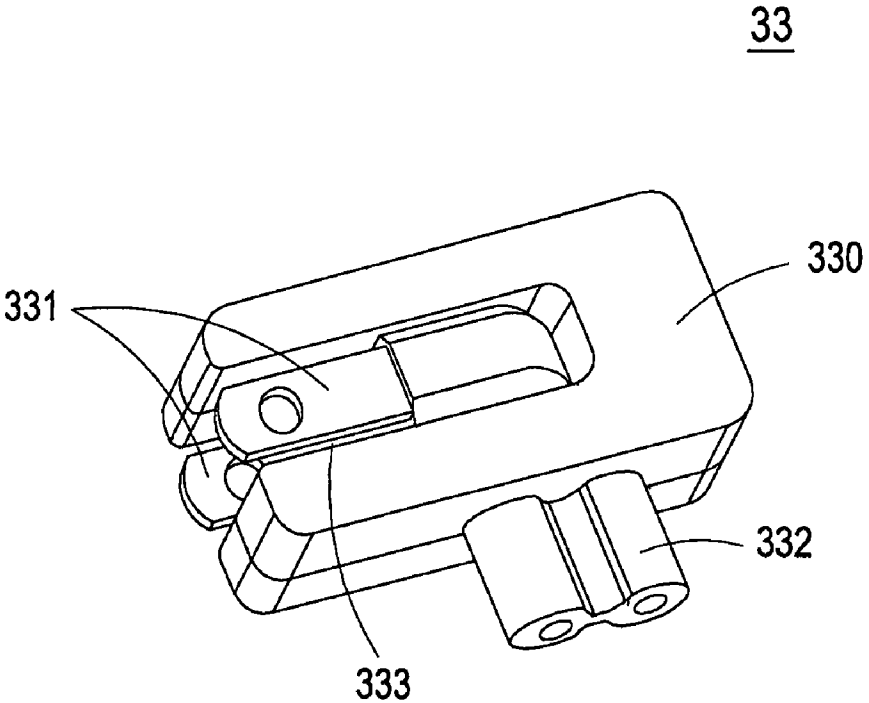
Figure 5C:
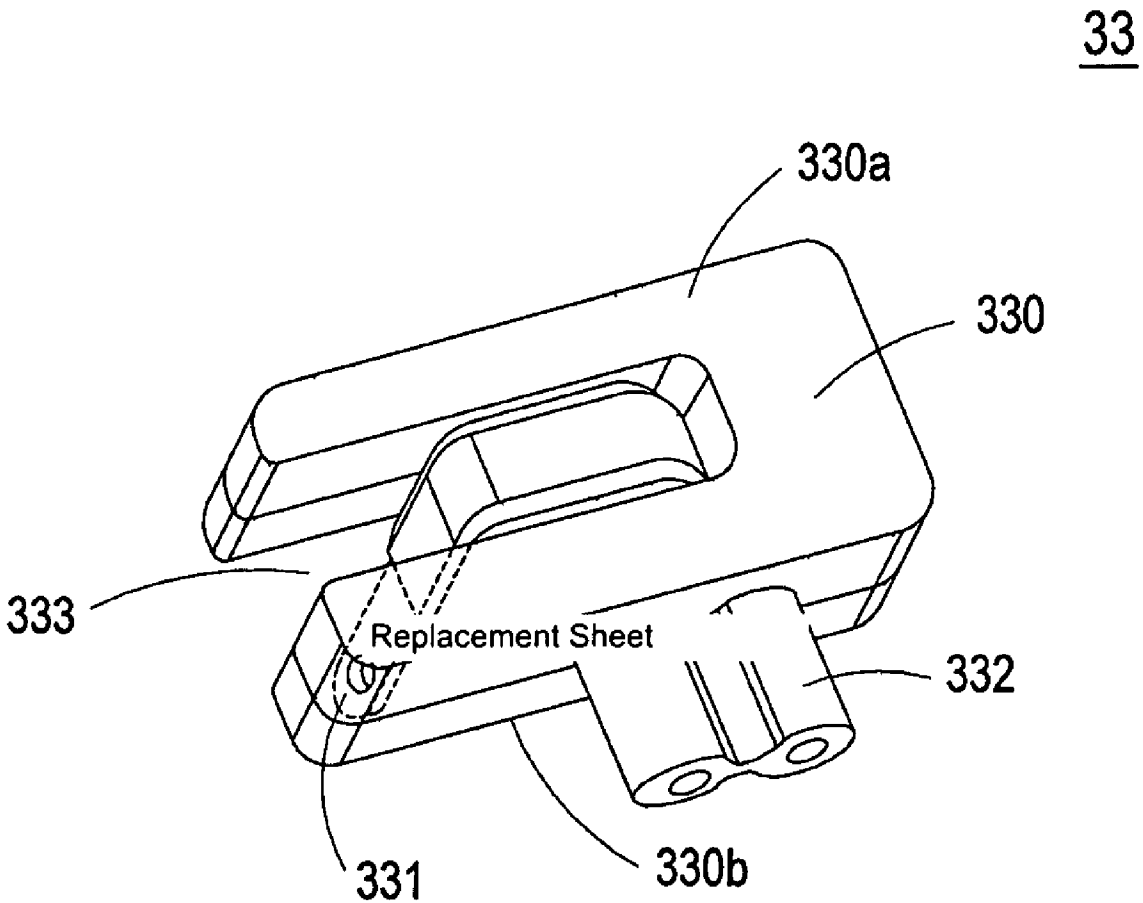

Please refer to FIGS. 5(*a*), 5(*b*), and 5(*c*), which illustrate other several usage situations of the foldable electrical connector 33. In these embodiments, the shaft of the foldable electrical connector 33 is closer to the bottom of the receiving portion 333 in compared to the embodiments of FIGS. 4(*a*)~4(*d*). As shown in FIG. 5(*a*), when the conductive pin 331 is rotated to be received in the receiving portion 333 of the housing 330, the conductive pin 331 fails to be plugged into the AC wall outlet and the foldable electrical connector 33 is not used. As shown in FIG. 5(*b*), the conductive pin 331 is rotated to be exposed out of the receiving portion 333 and protruded from a first surface 330*a* of the housing 330. As shown in FIG. 5(*c*), the conductive pin 331 is rotated to be exposed out of the receiving portion 333 and protruded from a second surface 330*b* of the housing 330. In this embodiment, the second surface 330*b* is opposite to the first surface 330*a*. In FIGS. 5(*b*) and 5(*c*), the conductive pin 331 may be plugged into an AC wall outlet to receive an AC voltage. As a consequence, multi-angle or all-oriented rotation of the conductive pin 331 is possible.

Figure 6:
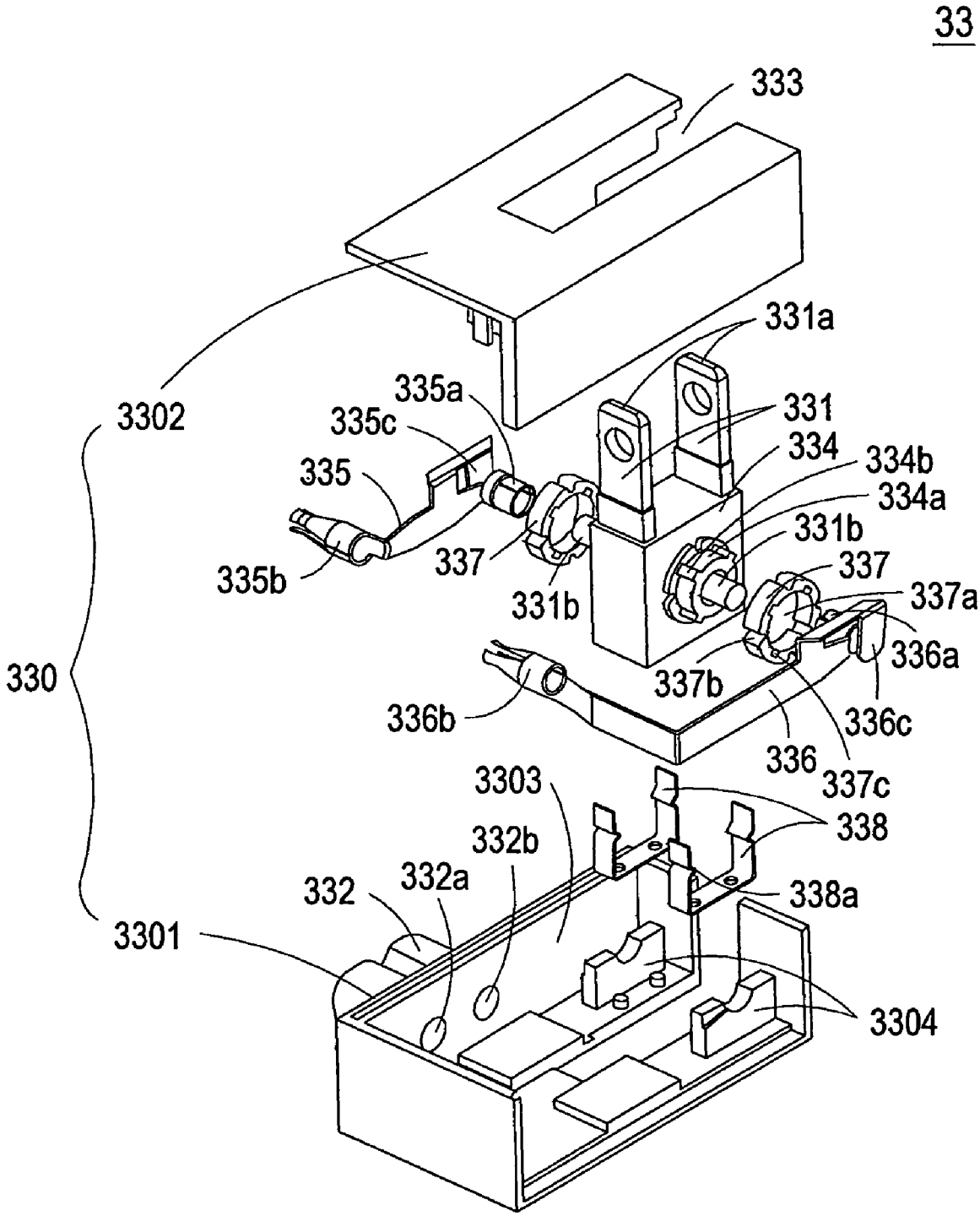
FIG. 6 is a schematic exploded view of the foldable electrical connector according to a preferred embodiment of the present invention.

Referring to FIG. 6, a schematic exploded view of the foldable electrical connector according to a preferred embodiment of the present invention is illustrated. The housing 330 includes a first cover 3301 and a second cover 3302. After the first cover 3301 and the second cover 3302 are combined together, the receiving portion 333 is formed. As shown in FIG. 6, two conductive pins 331 are carried on a carrier member 334, which is made of for example plastic material. The conductive pins 331 have first terminals 331*a* protruded from an edge surface of the carrier member 334 and second terminals 331*b* are protruded from two opposite side surfaces of the carrier member 334. The second terminals 331*b* of the conductive pins 331 are cooperatively formed as a conductive rotating shaft. Two cams 334*a* are disposed on these two opposite side surfaces of the carrier member 334.

The foldable electrical connector 33 further includes a first conducting element 335 and a second conducting element 336. The first conducting element 335 includes a first conducting part 335*a* and a second conducting part 335*b*. The second conducting element 336 includes a first conducting part 336*a* and a second conducting part 336*b*. The first conducting element 335 is substantially L-shaped such that the first conducting element 335 may be accommodated within a receptacle 3303 of the housing 330. Each of the first conducting parts 335*a* and 336*a* is substantially a sleeve with at least a seam at the sidewall thereof. The seams may facilitate resilient connection between the second terminals 331*b* of the conductive pins 331 and the sleeves (i.e. the first conducting parts 335*a* and 336*a*). Regardless of the rotational angle of the conductive pins 331, the first conducting parts 335*a* and 336*a* are always electrically connected to the second terminals 331*b* of the conductive pins 331. In some embodiments, the first conducting element 335 and the second conducting element 336 further includes third conductive parts 335*c* and 336*c*, respectively. The third conductive parts 335*c* and 336*c* are in contact with the tips of the second terminals 331*b* of the conductive pins 331 to assure that the first conducting element 335 and the second conducting element 336 are electrically connected to the second terminals 331*b* of the conductive pins 331. The tips of the second terminals 331*b* of the conductive pins 331 may have hemispheric surfaces. The second conductive part 335*b* of the first conducting element 335 and the second conductive part 336*b* of the second conducting element 336 are embedded into the channels 332*a* and 332*b* of the connecting member 332.

Please refer to FIG. 6 again. The foldable electrical connector 33 further includes two positioning members 337. The positioning members 337 are substantially positioning rings having perforations 337*a* in the center. The cams 334*a* of the carrier member 334 have protrusion structures 334*b* corresponding to first engaging elements 337*c* such as indention structures at the peripheries of the perforations 337*a* of the positioning members 337. When the protrusion structures 334*b* of the cams 334*a* are engaged with the first engaging elements 337*c* of the positioning members 337, the positioning members 337 are fixed onto the carrier member 334. The outer peripheries of the positioning members 337 further include several second engaging elements 337*b*, which are discretely arranged at regular intervals. Preferably, the second engaging elements 337*b* are also indention structures. In some embodiments, the foldable electrical connector 33 further includes two confining members 338. The confining members 338 are disposed within the receptacle 3303 of the housing 330 and corresponding to the positioning members 337. The confining members 338 are U-shaped resilient pieces. The confining members 338 include confining parts 338*a*, which are engaged with the second engaging elements 337*b* of the positioning members 337. When the confining parts 338*a* of the confining members 338 are engaged with the second engaging elements 337*b* of the positioning members 337, the carrier member 334 and the conductive pins 331 are orientated in a specified position. The foldable electrical connector 33 further includes two supporting members 3304. The supporting members 3304 are arranged on the inner surface of the first cover 3301 and corresponding to the second terminals 331*b* of the conductive pins 331. As a result, with the second terminals 331*b* of the conductive pins 331 serving as a rotating shaft, the multi-angle or all-oriented rotation of the conductive pin 331 is rendered. In some embodiments, the positioning members 337 and the confining members 338 are made of plastic or metallic material.

Figure 7:
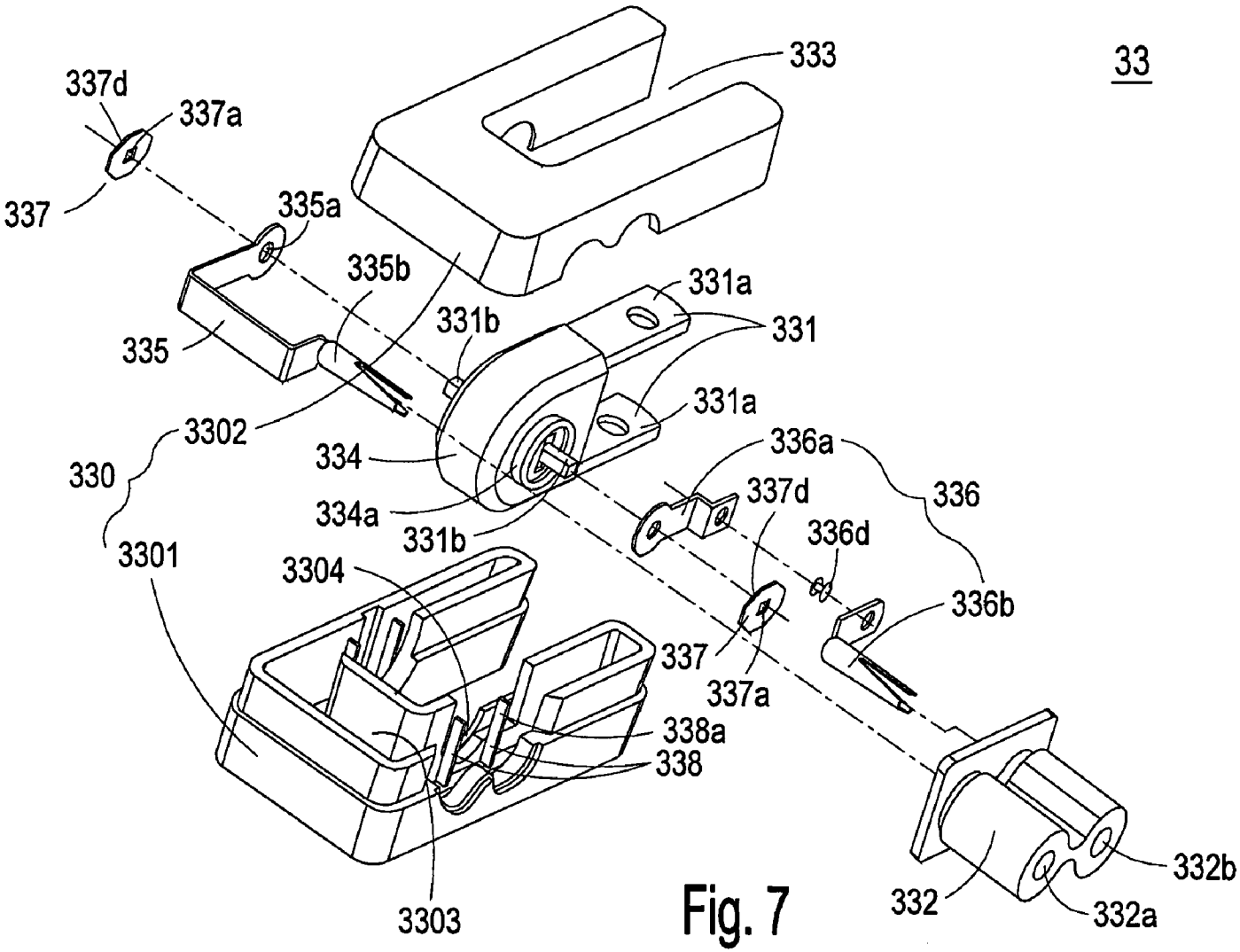
FIG. 7 is a schematic exploded view of the foldable electrical connector according to another preferred embodiment of the present invention.

Referring to FIG. 7, a schematic exploded view of the foldable electrical connector according to another preferred embodiment of the present invention is illustrated. The housing 330 includes a first cover 3301 and a second cover 3302. After the first cover 3301 and the second cover 3302 are combined together, the receiving portion 333 is formed. As shown in FIG. 7, two conductive pins 331 are carried on a carrier member 334, which is made of for example plastic material. The conductive pins 331 have first terminals 331*a* protruded from an edge surface of the carrier member 334 and second terminals 331*b* are protruded from two opposite side surfaces of the carrier member 334. Two cams 334*a* are disposed on these two opposite side surfaces of the carrier member 334 and cooperatively formed as a rotating shaft.

The foldable electrical connector 33 further includes a first conducting element 335 and a second conducting element 336. The first conducting element 335 includes a first conducting part 335*a* and a second conducting part 335*b*. The second conducting element 336 includes a first conducting part 336*a* and a second conducting part 336*b*. The first conducting element 335 is substantially U-shaped such that the first conducting element 335 may be accommodated within a receptacle 3303 of the housing 330. The first conducting parts 335*a* and 336*a* are electrically connected to the second terminals 331*b* of the conductive pins 331. The second conductive part 335*b* of the first conducting element 335 and the second conductive part 336*b* of the second conducting element 336 are embedded into the channels 332*a* and 332*b* of the connecting member 332. In some embodiments, the first conducting part 336*a* and the second conducting part 336*b* of the second conducting element 336 are separated components. By means of a coupling element 336*d*, the first conducting part 336*a* is combined with the second conducting part 336*b*.

Please refer to FIG. 7 again. The carrier member 334 and the conductive pins 331 are disposed in the receiving portion 333 of the housing 330. The foldable electrical connector 33 further includes two supporting members 3304. The supporting members 3304 are arranged on the inner surface of the first cover 3301 and corresponding to the cams 334*a*, which are disposed on opposite side surfaces of the carrier member 334. As a result, with the cams 334*a* serving as a rotating shaft, the multi-angle or all-oriented rotation of the conductive pin 331 is rendered. The foldable electrical connector 33 further includes two positioning members 337. The positioning members 337 are substantially polygonal positioning rings have perforations 337*a* in the center. The positioning members 337 are sheathed around the second terminals 331*b* of the conductive pins 331 such that the positioning members 337 are fixed onto the carrier member 334. The outer peripheries of the positioning members 337 further include several positioning parts 337*d*, which are the edges of the polygonal positioning rings. In some embodiments, the foldable electrical connector 33 further includes two confining members 338. The confining members 338 are disposed within the receptacle 3303 of the housing 330 and corresponding to the positioning members 337. The confining members 338 are U-shaped resilient pieces. The confining members 338 include confining parts 338*a*, which are sustained against or engaged with the positioning parts 337*d* of the positioning members 337. When the confining parts 338*a* of the confining members 338 are sustained against or engaged with the positioning parts 337*d* of the positioning members 337, the carrier member 334 and the conductive pins 331 are orientated in a specified position.

Figure 8:
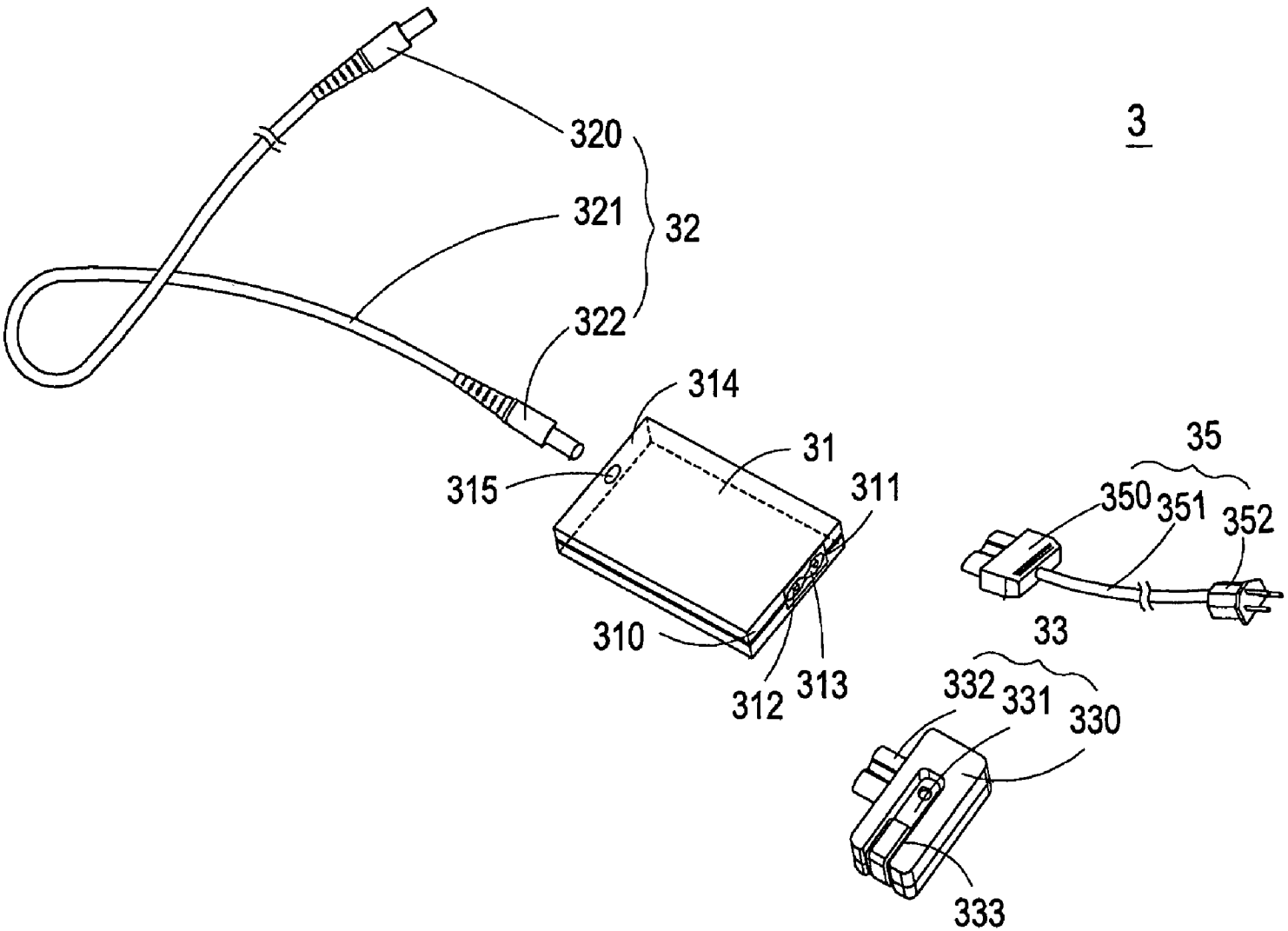
FIG. 8 schematically illustrates an embodiment of using the power supply apparatus.

Please refer to FIG. 8, which schematically illustrates an embodiment of using the power supply apparatus. In addition to the foldable electrical connector 33, the power supply apparatus further includes a second power connecting part 35. The second power connecting part 35 includes a first input plug 350, a power cable 351 and a second input plug 352. After the foldable electrical connector 33 or the second power connecting part 35 is selectively connected to the input socket 311 of the main body 31, the power supply apparatus can be plugged into the AC wall outlets of different specifications so as to receive external power.

Figure 9:
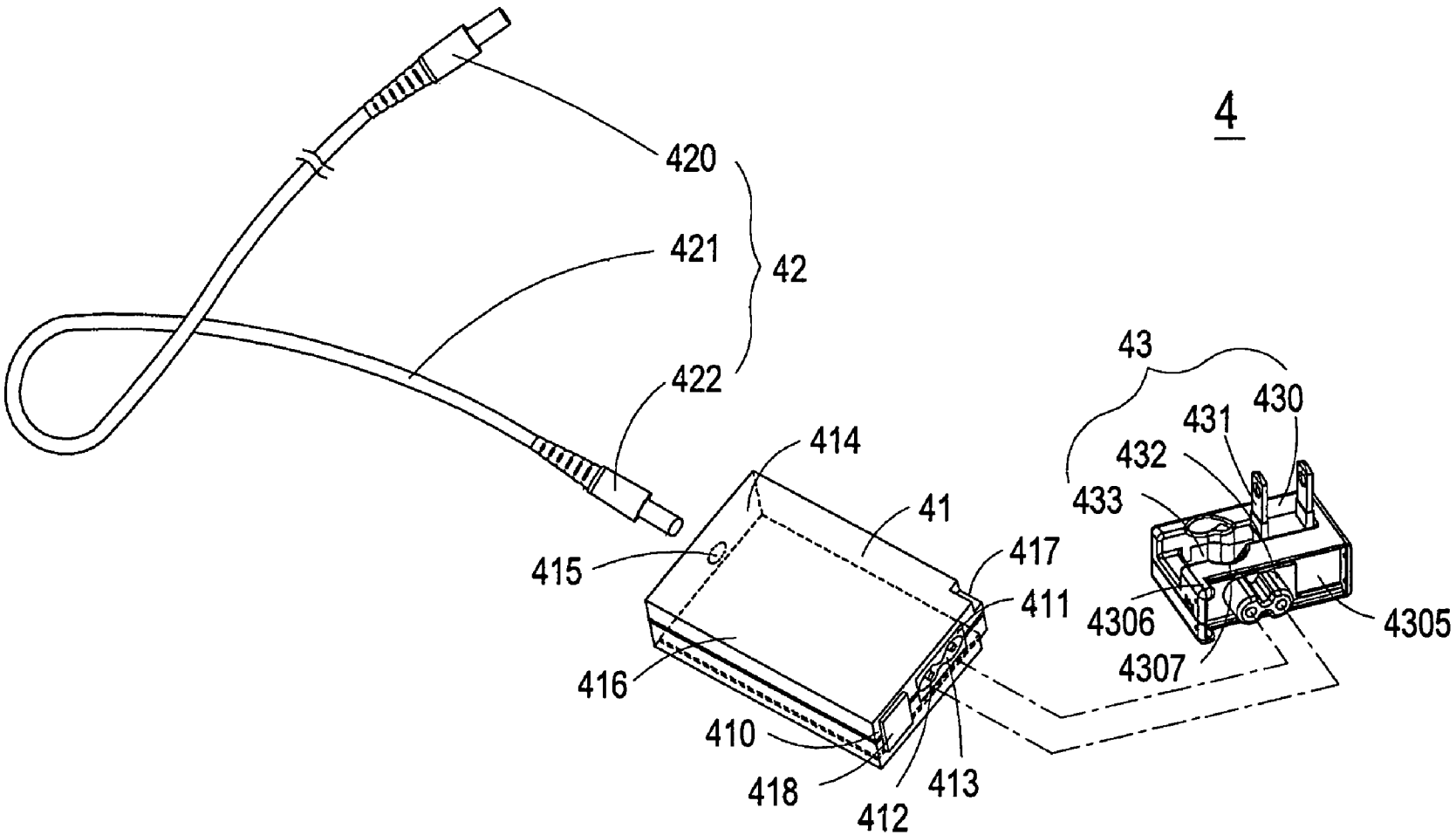
FIG. 9 is a schematic view of a power supply apparatus according to another preferred embodiment of the present invention.

Referring to FIG. 9, a schematic view of a power supply apparatus according to another preferred embodiment of the present invention is illustrated. The power supply apparatus 4 includes a main body 41, a first power connecting part 42 and a foldable electrical connector 43. The main body 41 of the power supply apparatus 4 includes a circuit board 416 having a power converting circuit (not shown) therein. A first side 410 of the main body 41 includes an input socket 411. The input socket 411 includes a plurality of conductive pins 412 having first terminals electrically connected to the circuit board 416 within the main body 41 and second terminals accommodated within a receiving portion 413 thereof. A second side 414 of the main body 41 includes an output socket 415. The output socket 415 is also electrically connected to the circuit board 416. The AC voltage transmitted from the external power source is converted by the circuitry of the circuit board inside the main body 41 into a regulated DC output voltage.

The first power connecting part 42 includes a first output plug 420, a power cable 421 and a second output plug 422. The second output plug 422 may be plugged into the output socket 415 of the main body 41. The first output plug 420 will be plugged into a power receiving socket of a portable electronic device such as a notebook computer, so that the regulated DC output voltage is transmitted to the portable electronic device.

Please refer to FIG. 9 again. The foldable electrical connector 43 includes a housing 430 and at least one conductive pin 431. The housing 430 includes a connecting member 432 and a receiving portion 433. The connecting member 432 is detachably inserted into the input socket 411 of the main body 41. The conductive pin 431 can be received in the receiving portion 433 and rotated with respect to the housing 430. In a case that the foldable electrical connector 43 is not used, the connecting member 432 may be detached from the input socket 411 of the main body 41 and a multi-angle rotation of the conductive pin 431 is rendered to have the conductive pin 431 stored within the receiving portion 433. Whereas, during operation of the power supply apparatus 4, the conductive pin 431 is rotated to be exposed out of the receiving portion 433 so as to be plugged into an AC wall outlet to receive an AC voltage.

Please refer to FIG. 9 again. The housing 430 of the foldable electrical connector 43 further includes an indentation 4305 formed on a sidewall and adjacent to the connecting member 432. The housing 430 of the foldable electrical connector 43 further includes an extension part 4306 extending from another sidewall and parallel to the connecting member 432. When the connecting member 432 of the foldable electrical connector 43 is detachably inserted into the input socket 411 of the main body 41, the indentation 4305 of the foldable electrical connector 43 can be engaged with a protrusion 418 formed on the first side 410 of the main body 41 and the extension part 4306 can be engaged with an engaging part 417 formed on one sidewall adjacent to the first side 410 so that the foldable electrical connector 43 can be tightly secured on the main body 41. In addition, the housing 430 of the foldable electrical connector 43 further includes a concavity 4307 formed on one surface and adjacent to the receiving portion 433. The concavity 4307 can provide a space for the finger of the user to exert a force upon the conductive pin 431 so as to rotate the conductive pin 431.

Figure 10:
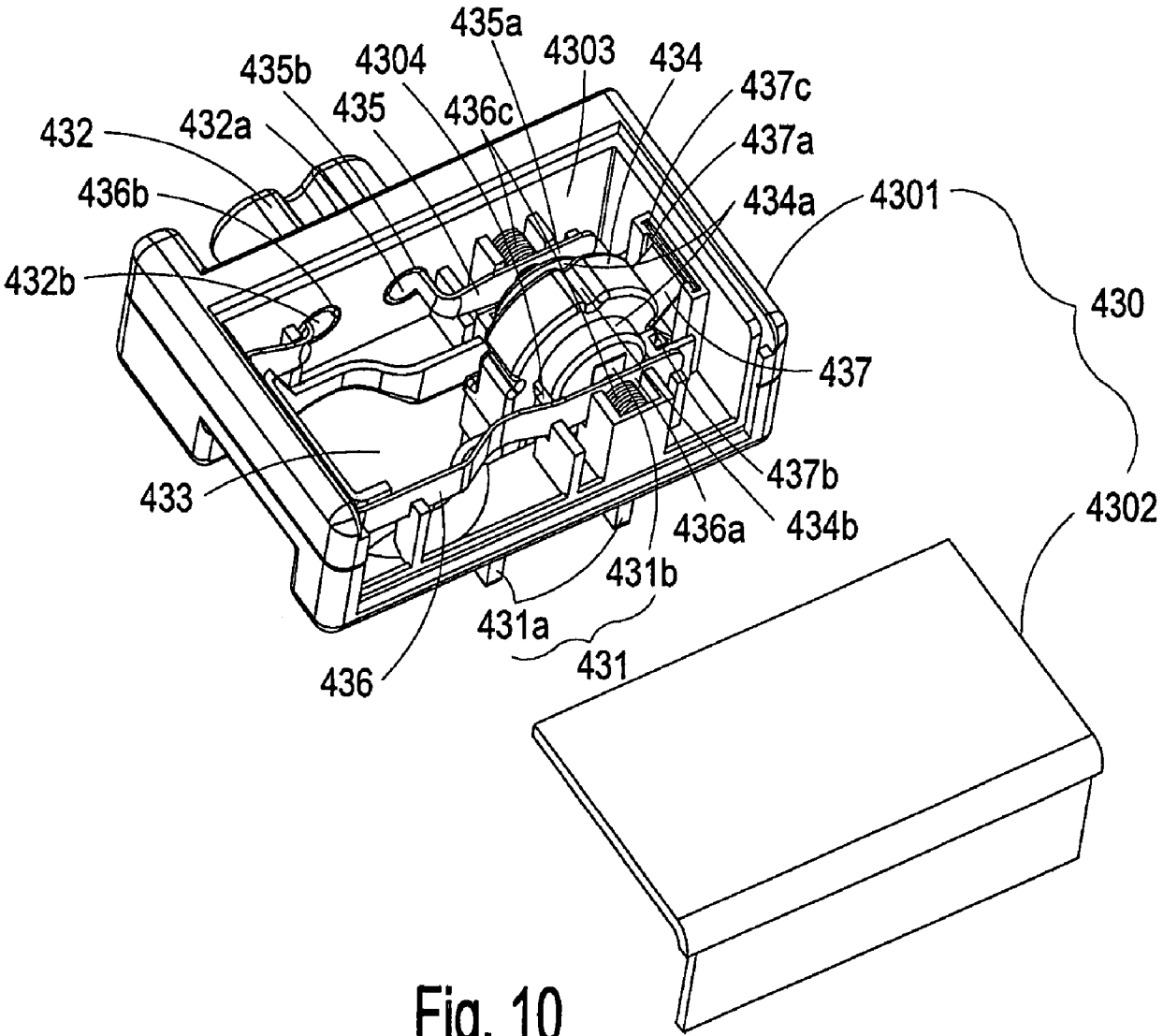
FIG. 10 is a schematic exploded view of the foldable electrical connector according to another preferred embodiment of the present invention.

Referring to FIG. 10, a schematic exploded view of the foldable electrical connector according to another preferred embodiment of the present invention is illustrated. The housing 430 includes a first cover 4301 and a second cover 4302. After the first cover 4301 and the second cover 4302 are combined together, the receiving portion 433 is formed. As shown in FIG. 10, two conductive pins 431 are carried on a carrier member 434, which is made of for example plastic material. The conductive pins 431 have first terminals 431 a protruded from an edge surface of the carrier member 434 and second terminals 431*b* are protruded from two opposite side surfaces of the carrier member 434. Two cams 434*a* are disposed on these two opposite side surfaces of the carrier member 434 and cooperatively formed as a rotating shaft.

The foldable electrical connector 43 further includes a first conducting element 435 and a second conducting element 436. The first conducting element 435 includes a first conducting part 435*a* and a second conducting part 435*b*. The second conducting element 436 includes a first conducting part 436*a* and a second conducting part 436*b*. The first conducting element 435 is substantially L-shaped such that the first conducting element 435 may be accommodated within a receptacle 4303 of the housing 430. Each of the first conducting parts 435*a* and 436*a* has a protrusion. The protrusion may facilitate connection with the second terminals 431*b* of the conductive pins 431.

Regardless of the rotational angle of the conductive pins 431, the first conducting parts 435*a* and 436*a* are always electrically connected to the second terminals 431*b* of the conductive pins 431. In some embodiments, two springs 436*c* are disposed in the housing 430 and bias the first conducting parts 435*a* and 436*a* of the first conducting element 435 and the second conducting element 436 respectively so that the first conducting parts 435*a* and 436*a* are always electrically connected to the second terminals 431*b* of the conductive pins 431 by the force provided by the springs 436*c*. The second conductive part 435*b* of the first conducting element 435 and the second conductive part 436*b* of the second conducting element 436 are embedded into the channels 432*a* and 432*b* of the connecting member 432.

Please refer to FIG. 10 again. The foldable electrical connector 43 further includes a positioning member 437. The positioning member 437 is a resilient member having two ends 437*a* inserted into a slot 437*c* formed on an inner sidewall of the housing 430. The positioning member 437 has an engaging element 437*b* such as a protrusion structure at the central portion and corresponding to the indention structures 434*b* formed on the peripheries of the carrier member 434. The indention structures 434*b* formed on the peripheries of the carrier member 434 are discretely arranged at regular intervals. When the engaging element 437*b* of the positioning member 437 is engaged with one of the indention structures 434*b* of the carrier member 434, the carrier member 434 is fixed onto the positioning members 437. The foldable electrical connector 43 further includes two supporting members 4304. The supporting members 4304 are arranged on the inner surface of the first cover 4301 and corresponding to the cams 434*a* of the carrier member 434. As a result, with the cams 434*a* serving as a rotating shaft, the multi-angle or all-oriented rotation of the conductive pin 431 is rendered. In some embodiments, the positioning member 437 is made of metallic material.

From the above description, the foldable electrical connector is capable of permitting multi-angle and all-oriented rotation of the conductive pin, so that the conductive pin may be stored or protruded out as required. In addition, since the foldable electrical connector is securely connected to the input socket of the main body, the foldable electrical connector is not easily detached from the main body in response to an external force. Moreover, by carrying an additional conventional power connecting part, the power supply apparatus can be plugged into the AC wall outlets of different specifications to receive external power, so that the application range of the power supply apparatus is widened.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power supply apparatus comprising:

a main body including a power converting circuit therein and having a first socket at a first side thereof;

a first power connecting part having an end connected to said main body; and a foldable electrical connector including a housing, at least two conductive pins, a first conducting element and a second conducting element, said housing including a connecting member and a receiving portion, said conductive pins being carried by a carrier member and having first terminals and second terminals protruded from said carrier member, each of said first conducting element and said second conducting element comprising a first conducting part and a second conducting part, said first conducting parts of said first and second conducting elements electrically connected to said second terminals of said conductive pins, and said second conducting parts of said first and second conducting elements electrically connected to said first socket of said main body while said connecting member being connected to said first socket of said main body, wherein said conductive pins are disposed in said receiving portion and multi-angularly rotatable with respect to said housing so as to be selectively stored in said receiving portion or protruded from said housing.

2. The power supply apparatus according to claim 1 wherein said housing includes a first cover and a second cover, and a receptacle is defined when said first cover and said second cover are combined together.

3. The power supply apparatus according to claim 1 wherein said power converting circuit is provided on a circuit board, and said first socket is electrically connected to said circuit board.

4. The power supply apparatus according to claim 3 wherein said main body further include a second socket at a second side thereof, and said second socket is electrically connected to said circuit board.

5. The power supply apparatus according to claim 4 wherein said first power connecting part includes a first output plug, a power cable and a second output plug, wherein said first output plug is electrically connected to an electronic device and said second output plug is electrically connected to said second socket of said main body.

6. The power supply apparatus according to claim 1 wherein said receiving portion of said foldable electrical connector is concavely extended from a first sidewall of said housing.

7. The power supply apparatus according to claim 6 wherein said connecting member is protruded from a second sidewall of said housing, said second sidewall being next to said first sidewall.

8. The power supply apparatus according to claim 6 wherein said conductive pins are stored within said receiving portion when said conductive pins are rotated to be received in said receiving portion.

9. The power supply apparatus according to claim 6 wherein said conductive pins are protruded from one selected from a group consisting of a first surface, a second surface and said first sidewall of said main body to be electrically connected to an external power source when said conductive pins are rotated to be exposed out of said receiving portion, wherein said second surface is opposite to said first surface.

10. The power supply apparatus according to claim 1 wherein said foldable electrical connector includes two conductive pins carried by said carrier member, wherein said first terminals of said conductive pins protruded from an edge surface of said carrier member and said second terminals of said conductive pins protruded from two opposite sides of said carrier member, and said carrier member is made of plastic material, and said foldable electrical connector further includes two cams disposed on said two opposite sides of said carrier member.

11. The power supply apparatus according to claim 10 wherein said connecting member is detachably connected to said first socket of said main body, and said second conducting parts of said first conducting element and said second conducting element are embedded into two channels in said connecting member, respectively.

12. The power supply apparatus according to claim 11 further comprising two springs disposed in said housing of said foldable electrical connector and biasing against said first conducting parts of said first conducting element and said second conducting element, respectively.

13. The power supply apparatus according to claim 11 wherein said foldable electrical connector further includes a positioning member and said carrier member further includes plural indention structures; wherein said positioning member includes an engaging element engaged with one of said indention structures of said carrier member so that said carrier member and said two conductive pins are orientated in a specified position.

14. The power supply apparatus according to claim 11 wherein said foldable electrical connector further includes two positioning members and two confining members, wherein said positioning member includes a first engaging element engaged with a protrusion structure of corresponding cam and a second engaging element engaged with a confining part of corresponding confining member, so that said carrier member and said two conductive pins are orientated in a specified position.

15. The power supply apparatus according to claim 14 wherein said positioning members are positioning rings and said confining members are U-shaped resilient pieces.

16. The power supply apparatus according to claim 14 wherein said positioning members are polygonal positioning rings and said confining members are U-shaped resilient pieces.

17. The power supply apparatus according to claim 14 wherein said foldable electrical connector further includes two supporting members arranged on the inner surface of said housing and corresponding to said second terminals of said two conductive pins, so that said two conductive pins are rotated within said receiving portion with said second terminals of said two conductive pins serving as a rotating shaft.

18. A foldable electrical connector of a power supply apparatus, said power supply apparatus comprising a main body including a power converting circuit therein and having a first socket at a first side thereof, said foldable electrical connector comprising:

a housing including a connecting member and a receiving portion, wherein said connecting member is connected to said first socket of said main body; and at least two conductive pins being carried by a carrier member and having first terminals and second terminals protruded from said carrier member; and a first conducting element and a second conducting element, each of said first conducting element and said second conducting element comprising a first conducting part and a second conducting part, said first conducting parts of said first and second conducting elements electrically connected to said second terminals of said conductive pins, and said second conducting parts of said first and second conducting elements electrically connected to said first socket of said main body while said connecting member being connected to said first socket of said main body;

wherein said conductive pins are disposed in said receiving portion and multi-angularly rotatable with respect to said housing so as to be selectively stored in said receiving portion or protruded from said housing.

19. A power supply apparatus comprising:

a main body including a power converting circuit therein and having a first socket at a first side thereof;

a first power connecting part having an end connected to said main body;

a second power connecting part including a first input plug, a power cable and a second input plug, wherein said first input plug is selectively connected to said first socket of said main body; and a foldable electrical connector including a housing, at least two conductive pins, a first conducting element and a second conducting element, said housing including a connecting member and a receiving portion, said conductive pins being carried by a carrier member and having first terminals and second terminals protruded from said carrier member, each of said first conducting element and said second conducting element comprising a first conducting part and a second conducting part, said first conducting parts of said first and second conducting elements electrically connected to said second terminals of said conductive pins, and said second conducting parts of said first and second conducting elements electrically connected to said first socket of said main body while said connecting member being connected to said first socket of said main body, wherein said conductive pins are disposed in said receiving portion and multi-angularly rotatable with respect to said housing, and said connecting members is selectively connected to said first socket of said main body, wherein a first input voltage is received by said second input plug when said first input plug of said second power connecting part is connected to said first socket of said main body, and a second input voltage is received by said conductive pins when said connecting member of said foldable electrical connector is connected to said first socket of said main body.

20. The power supply apparatus according to claim 19 wherein said first power connecting part includes a first output plug, a power cable and a second output plug.

* * * * *